US006427055B2

(12) United States Patent
Sawada

(10) Patent No.: US 6,427,055 B2
(45) Date of Patent: Jul. 30, 2002

(54) CHARGE CONTROL DEVICE FOR AN IMAGE FORMING APPARATUS WHICH IS DEPENDENT ON AMBIENT TEMPERATURE

(75) Inventor: Akira Sawada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/843,861

(22) Filed: Apr. 30, 2001

(30) Foreign Application Priority Data

May 2, 2000 (JP) ..... 2000-133347

(51) Int. Cl.[7] ..... G03G 15/02
(52) U.S. Cl. ..... 399/44; 399/50; 399/176
(58) Field of Search ..... 399/44, 50, 89, 399/174, 176

(56) References Cited

U.S. PATENT DOCUMENTS

| | | | | |
|---|---|---|---|---|
| 5,479,243 A | * | 12/1995 | Kurokawa et al. | 399/176 X |
| 5,585,896 A | * | 12/1996 | Yamazaki et al. | 399/44 X |
| 5,606,399 A | * | 2/1997 | Kikui | 399/44 X |
| 5,649,265 A | * | 7/1997 | Tabuchi | 399/44 |
| 5,678,129 A | * | 10/1997 | Yasuda et al. | 399/50 |
| 5,749,022 A | * | 5/1998 | Kikui et al. | 399/50 |
| 5,805,954 A | * | 9/1998 | Takahashi | 399/44 |
| 5,966,558 A | * | 10/1999 | Kikui | 399/44 |
| 6,263,175 B1 | | 7/2001 | Sawada et al. | 399/100 |

FOREIGN PATENT DOCUMENTS

| | | | |
|---|---|---|---|
| JP | 1-231073 | * | 9/1989 |
| JP | 4-186381 | * | 7/1992 |
| JP | 4-316064 | * | 11/1992 |
| JP | 7-168420 | | 7/1995 |
| JP | 11-95529 | | 4/1999 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

An image forming apparatus includes a voltage control circuit and a decision circuit. The voltage control circuit varies a voltage to be applied to a charge roller at preselected intervals in correspondence to the non-image area of a photoconductive element. A photosensor senses the reflection density of a particular control pattern formed on the drum 1 before and after the above voltage is varied. The voltage control circuit controls the voltage to be applied to the charge roller in accordance with a ratio between the resulting outputs of the photosensor. The decision circuit determines, at the start-up of the apparatus, whether or not to cause the voltage control circuit 31 to execute the voltage control in accordance with ambient temperature sensed by a temperature sensor. If the ambient temperature is higher than a reference temperature, the voltage control circuit is inhibited from executing the control.

6 Claims, 5 Drawing Sheets

CHARGE CONTROL DEVICE FOR AN IMAGE FORMING APPARATUS WHICH IS DEPENDENT ON AMBIENT TEMPERATURE

BACKGROUND OF THE INVENTION

The present invention relates to a copier, printer, facsimile apparatus or similar image forming apparatus of the type including a charging member that contacts or adjoins an image carrier.

A current trend in the image forming art is toward a miniature image forming apparatus in which a photoconductive element or image carrier, a developing device, a charger and so forth are constructed into a unit. A predominant type of charger includes a charging member implemented as a charge roller contacting the photoconductive element. A voltage is applied between the charge roller and the photoconductive element for uniformly charging the surface of the element.

The problem with the image forming apparatus of the type holding the charge roller in contact with the photoconductive drum is that toner left on the element after image transfer is apt to smear the charge roller. In light of this, sponge or similar cleaning pad is usually held in contact with the charge roller in order to clean the charge roller. The cleaning pad, however, has its cleaning ability lowered as the apparatus is operated over a long period of time, failing to remove deposits including toner and paper dust and other impurities from the charge roller. The deposits lower a discharging ability and thereby bring about background contamination. Background contamination ascribable to such deposits is more likely to occur when the charging member is implemented as a blade on which the cleaning pad cannot be mounted.

In order to solve the above-described problem, it is a common practice to execute, before a regular image forming operation, a prerotation mode operation for forming a pattern including a white portion and a gray portion on the photoconductive element. An optical sensor senses the reflection sensitivity of the white portion and that of the gray portion. A voltage to be applied to the charge roller is controlled on the basis of the resulting output of the sensor for thereby making up for the fall of the discharging ability and obviating background contamination.

The above conventional scheme, however, consumes extra power and extra time for causing the drum to rotate and causing a developing unit to operate to form the particular pattern before a regular image forming operation. This slows down the warm-up of the apparatus after the turn-on of a main switch or the recovery from a sleep mode.

A standard called ZESM (Zero Energy Standby Mode) has recently been proposed. In this respect, the warm-up time after the turn-on of a main switch or the recovery from a sleep mode should be further reduced.

Technologies relating to the present invention are disclosed in, e.g., Japanese Patent Laid-Open Publication Nos. 7-168420 and 11-95529.

SUMMARY OF THE INVENTION

It is an object of the present invention to provide an image forming apparatus capable of reducing the warm-up time.

In accordance with the present invention, an image forming apparatus includes charging member contacting or adjoining a photoconductive element for uniformly charging the surface of the element. A latent image forming device forms a latent image on the charged surface of the photoconductive element. A developing unit develops the latent image with toner by reversal development to thereby form a corresponding toner image. A temperature sensor is responsive to ambient temperature around the image forming apparatus. A voltage applying device applies a DC voltage to the charging member. A photosensor is responsive to the reflection density of the surface of the photoconductive element. A voltage control circuit varies the DC voltage in correspondence to the non-image area of the surface of the photoconductive element at preselected intervals, causes the photosensor to sense the deflection density of the surface of the element before and after the variation of the DC voltage, and controls a voltage to be applied from the voltage applying device to the charging member in accordance with a ratio between the resulting outputs of the photosensor. A decision circuit determines whether or not to cause the voltage control circuit to execute control over the voltage.

Also, in accordance with the present invention, an image forming apparatus includes charging member contacting or adjoining a photoconductive element for uniformly charging the surface of the element. A latent image forming device forms a latent image on the charged surface of the photoconductive element. A developing unit develops the latent image with toner by reversal development to thereby form a corresponding toner image. A temperature sensor is responsive to ambient temperature around the image forming apparatus. A voltage applying device applies a DC voltage to the charging member. A photosensor is responsive to the reflection density of the surface of the photoconductive element. A voltage control circuit varies the DC voltage in correspondence to the non-image area of the surface of the photoconductive element at preselected intervals, causes the photosensor to sense the deflection density of the surface of the element before and after the variation of the DC voltage, and controls a voltage to be applied from the voltage applying device to the charging member in accordance with a ratio between the resulting outputs of the photosensor. A decision circuit inhibits the voltage control circuit from executing control over the voltage for a preselected period of time necessary for the apparatus to be warmed up to a printing state, and then causes the voltage control circuit to execute the control on the elapse of the preselected period of time.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
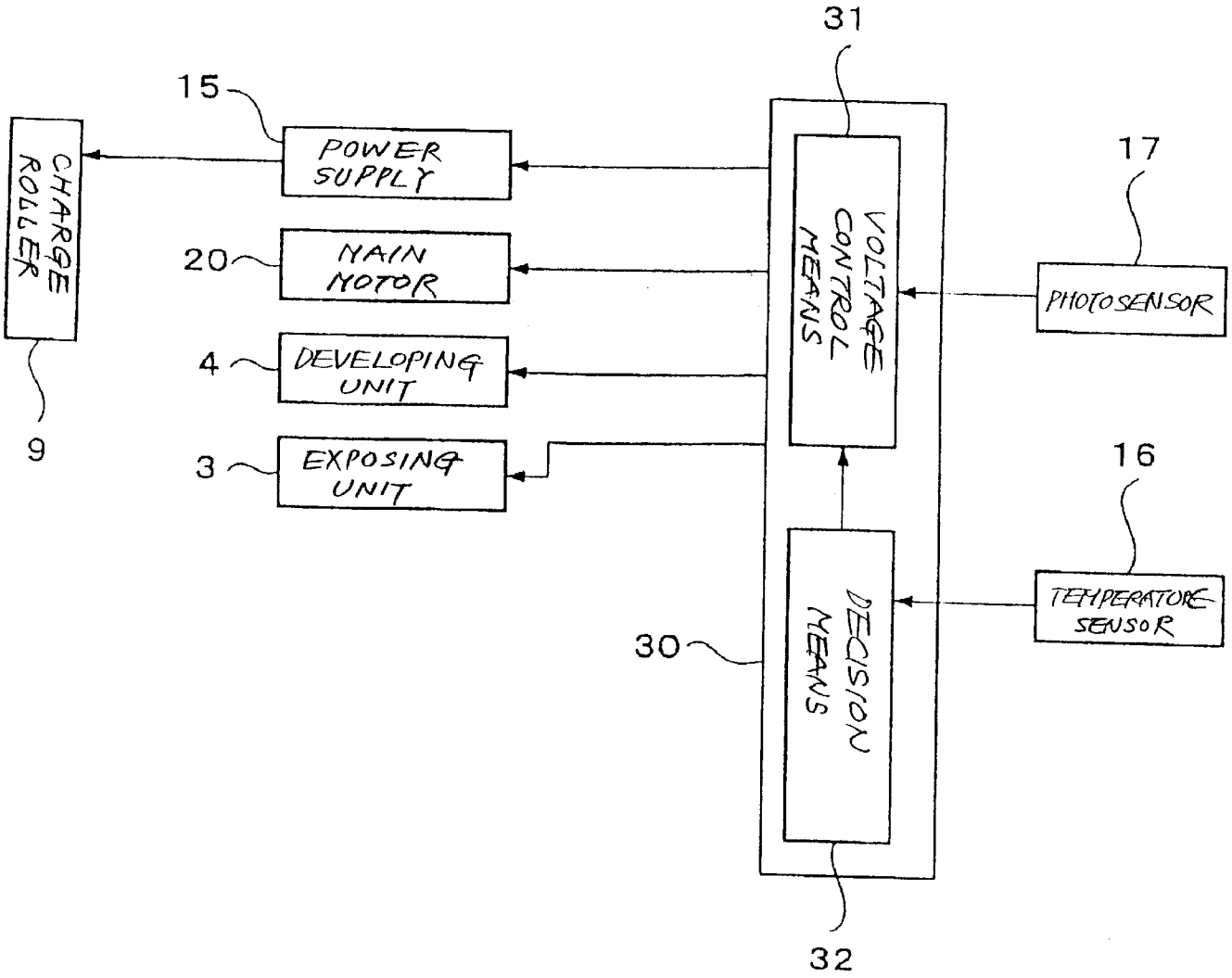
FIG. 1 is a block diagram schematically showing a control system included in an image forming apparatus embodying the present invention.
Figure 2:
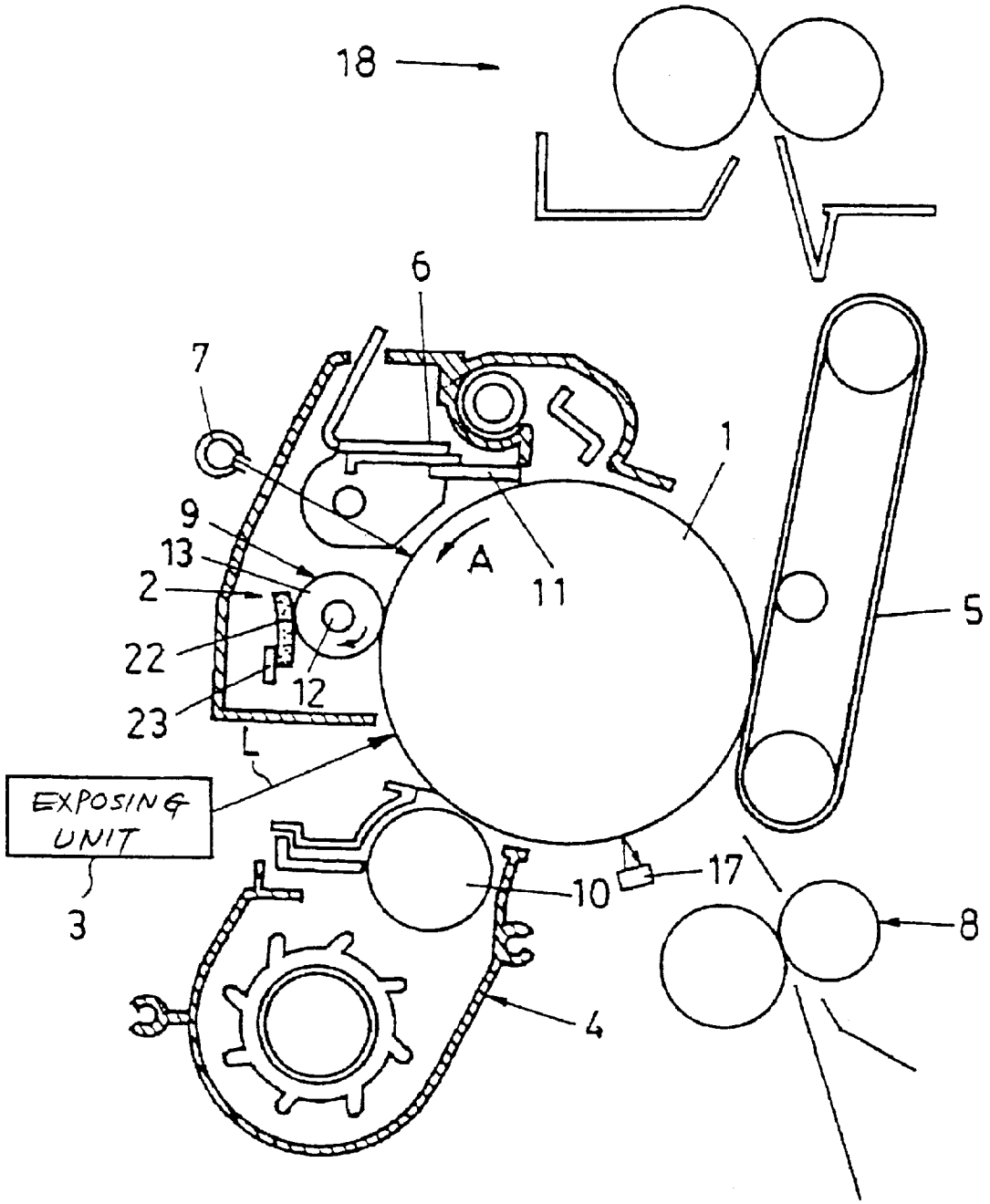
FIG. 2 is a view showing the construction of an image forming section included in the illustrative embodiment.

Referring to FIG. 2 of the drawings, an image forming apparatus embodying the present invention, particularly an image forming section thereof, is shown. FIG. 1 shows a control system for applying a voltage to a charging member included in the image forming apparatus.

As shown in FIGS. 1 and 2, a main motor 20 causes a photoconductive drum or image carrier 1 to rotate in a direction indicated by an arrow A. Arranged around the drum 1 are a charger 2, an exposing unit or latent image forming means 3, a developing unit or developing means 4, and a temperature sensor 16. A power supply 15 applies a voltage to a charge roller or charging member 9 included in the charger 2. The charger roller 9 uniformly charges the surface of the drum 1 while contacting or adjoining the surface of the drum 1. The exposing unit 3 scans the charged surface of the drum 1 with a laser beam L to thereby form a latent image. The developing unit 4 deposits toner on the latent image for thereby producing a corresponding toner image by reversal development.

The toner image is transferred from the drum 1 to an image transfer belt 5, which in turn transfers the toner image to a paper sheet or similar recording medium. A cleaner 6 removes toner left on the drum 1 after the transfer of the toner image to the paper sheet. A discharge lamp 7 discharges the surface of the drum 1.

A photosensor 17 senses the reflection density of the surface of the drum 1. The voltage to be applied to the charge roller 9 and the toner concentration of the developing unit 4 are controlled on the basis of the output of the photosensor 17. Fresh toner is replenished from a toner replenishing device, not shown, to the developing unit 4 via a toner inlet not shown.

In operation, while the main motor 20 drives the drum 1 in the direction A, the discharge lamp 7 discharges the surface of the drum 1 so as to initialize it to a reference potential of 0 V to −150 V. Subsequently, the charger roller 9 uniformly charges the surface of the drum 1 to about −1,000 V.

The laser beam L issuing from the exposing unit 3 scans the uniformly charged surface of the drum 1. As a result, the surface potential of the drum 1 is varied to 0 V to −200 V in portions representative of an image. Toner deposited on a developing sleeve 10, which is included in the developing unit 4, is transferred from the sleeve 10 to the above portions of the drum 1, forming a toner image. The drum 1 in rotation conveys the toner image formed thereon to an image transfer position where the drum 1 and image transfer belt 5 contact each other.

A paper sheet or similar recording medium is fed from a sheet feeding section, not shown, to a registration roller pair 8. The registration roller pair 8 conveys the paper sheet at such timing that the leading edge of the paper sheet meets the leading edge of the toner image carried on the drum 1. At the image transfer position, the toner image is transferred from the drum 1 to the paper sheet. The image transfer belt 5 conveys the paper sheet carrying the toner image thereon to a fixing unit 18. The fixing unit 18 fixes the toner image on the paper sheet with heat and pressure. Finally, the paper sheet or print is driven out to, e.g., a print tray not shown. The cleaner 6 scrapes off the toner left on the drum 1 after the image transfer with a blade 11. Subsequently, the discharge lamp 7 discharges the surface of the drum 1. The procedure described above is repeated thereafter.

As shown in FIG. 2, the charge roller 2 is made up of a metallic core 12 and conductive,rubber 13 covering the core 12 except for opposite end portions of the core 12. A surface layer maybe formed on the conductive rubber 13, if desired. The rubber 13 has low hygroscopicity and stable resistance. The charge roller 9 is caused to rotate by the drum 1 with the rubber 13 contacting the surface of the drum 1. The power supply 15 applies a high-tension voltage to the core 12, so that the charge roller 9 uniformly charges the surface of the drum 1.

A roller cleaning member 22 is held in contact with the surface of the charge roller 9 and implemented by, e.g., sponge or similar foam material or a brush. The roller cleaning member 22 is adhered to a holder 23 by, e.g., a two-sided adhesive tape. Fine toner particles and impurities deposited on the drum 1 are apt to smear the surface of the charge roller 9, which constantly contacts the surface of the drum 1, causing irregular charging to occur. In the illustrative embodiment, the roller cleaning member 22 removes the toner from the charge roller 9 and thereby obviates irregular charging ascribable to the contamination of the charge roller 9.

The photosensor 17 is made up of a light emitting portion and a light-sensitive portion. The quantity of light to issue from the sensor 17 is variable. The sensor 17 is similar to a sensor customarily used to sense the toner content of a two-ingredient type developer, i.e., a toner and carrier mixture.

The power supply 15 plays the role of voltage applying means for applying a DC voltage to the charge roller 9.

As shown in FIG. 1, the control system includes voltage control means 31 and decision means 32. The voltage control means 31 varies the DC voltage to be applied to the charge roller 9 at preselected intervals $T_1$ through $T_3$ (see FIG. 4) in correspondence to the non-image area of the drum 1. The optical sensor 17 senses the reflection density of a particular control pattern formed on the drum 1 before and after the above voltage is varied. The voltage control means 31 controls the voltage to be applied from the power supply 15 to the core 12 of the charge roller 9 in accordance with a ratio between the resulting outputs of the sensor 17. The decision means 32 determines, at the start-up of the apparatus, whether or not to cause the voltage control means 31 to execute the voltage control in accordance with ambient temperature being sensed by a temperature sensor 16.

The voltage control means 31 and decision means 32 are implemented as a microcomputer. The microcomputer includes a CPU (Central Processing Unit), a ROM (Read Only Memory), a RAM (Random Access Memory), and an I/O (Input/Output) circuit although not shown specifically. The CPU has various deciding and processing functions. The ROM stores various processing programs and fixed data while the RAM stores various interim data. The microcomputer is included in a controller 30.

The controller 30 receives the output of the photosensor 17 representative of the reflection density of the surface of the drum 1 and the output of the temperature sensor 16 representative of ambient temperature. In response, the controller 30 feeds a signal to the power supply 15 in order to control the voltage to be applied to the core 12 of the charge roller 9.

Figure 3:
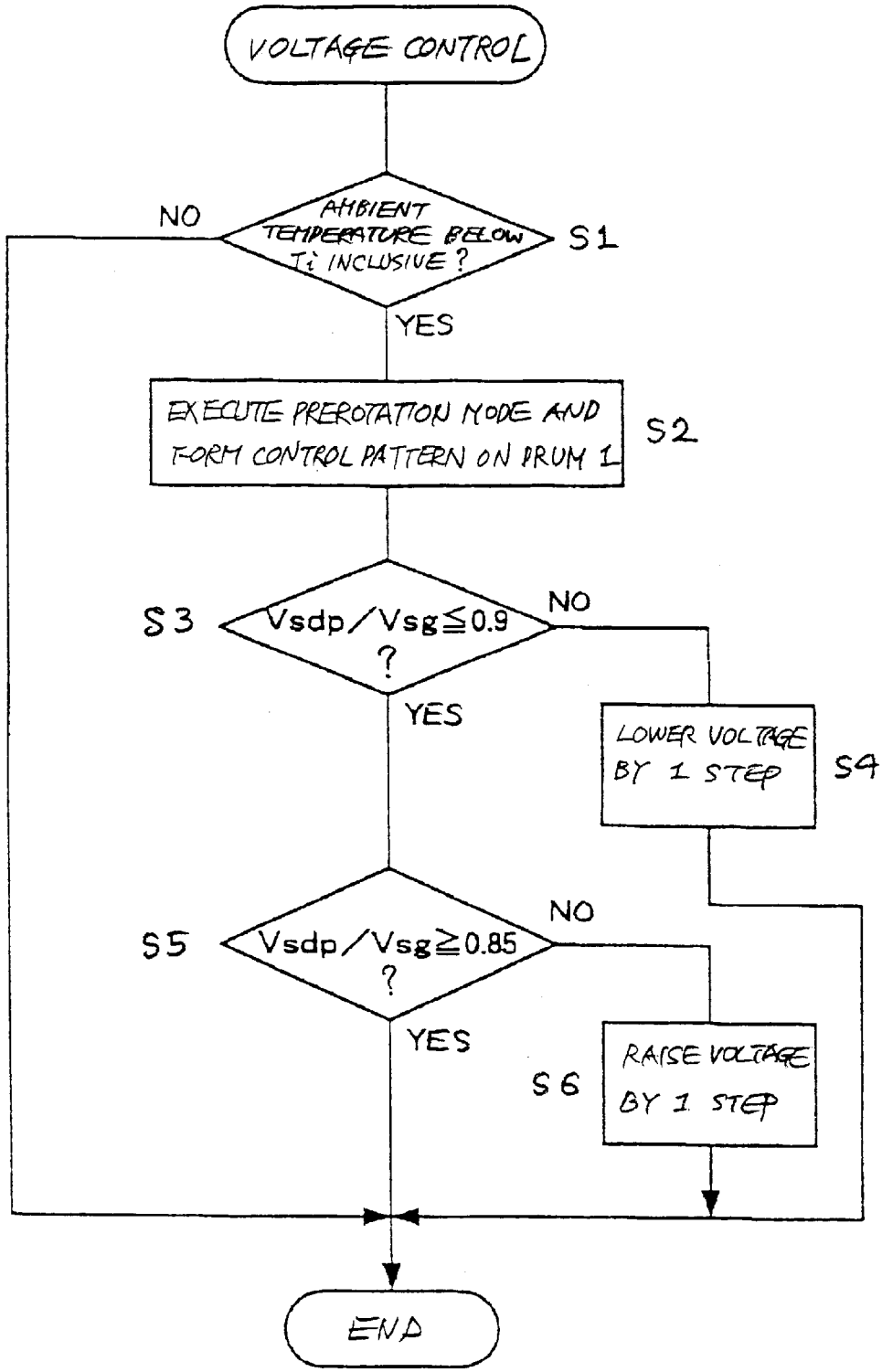
FIG. 3 is a flowchart demonstrating a specific operation of the illustrative embodiment.

Reference will be made to FIG. 3 for describing a specific voltage control procedure to be executed by the microcomputer of the controller 30 (simply controller 30 hereinafter). The controller 30 starts executing the procedure of FIG. 3 in response to an ON signal output from a main switch, not shown, arranged on the apparatus or a signal representative of recovery from a sleep mode. If the apparatus has not been used up to the time when the above signal appears, the fixing unit 18, FIG. 2, remains at low temperature.

On the start of the procedure shown in FIG. 3, the controller 30 determines whether or not ambient temperature sensed by the temperature sensor 16 is equal to or lower than a preselected reference temperature Ti (step S1). If the ambient temperature is higher than the reference temperature Ti (NO, step S1), then the controller 30 ends the procedure because a prerotation mode meant for the voltage control is not necessary. Consequently, power is immediately concentrated on the fixing unit 18 such the fixing unit 18 consumes more than 90% of the power. The fixing unit 18 is therefore heated to a preselected temperature within 10 seconds.

Experimental results showed that when power was not concentrated on the fixing unit 18 by more than 90%, but was applied to, e.g., a main motor for driving an image forming system, the fixing unit 18 failed to reach the preselected temperature within 10 seconds.

If ambient temperature is equal to or lower than the reference temperature Ti (YES, step S1), then the controller 30 drives the main motor 20 and causes it to consume power although slowing down the warm-up of the apparatus. Specifically, the controller 30 sets up a prerotation mode for optimizing the voltage to be applied to the charge roller 9 and forms a particular control pattern on the drum 1 (step S2).

Figure 4:
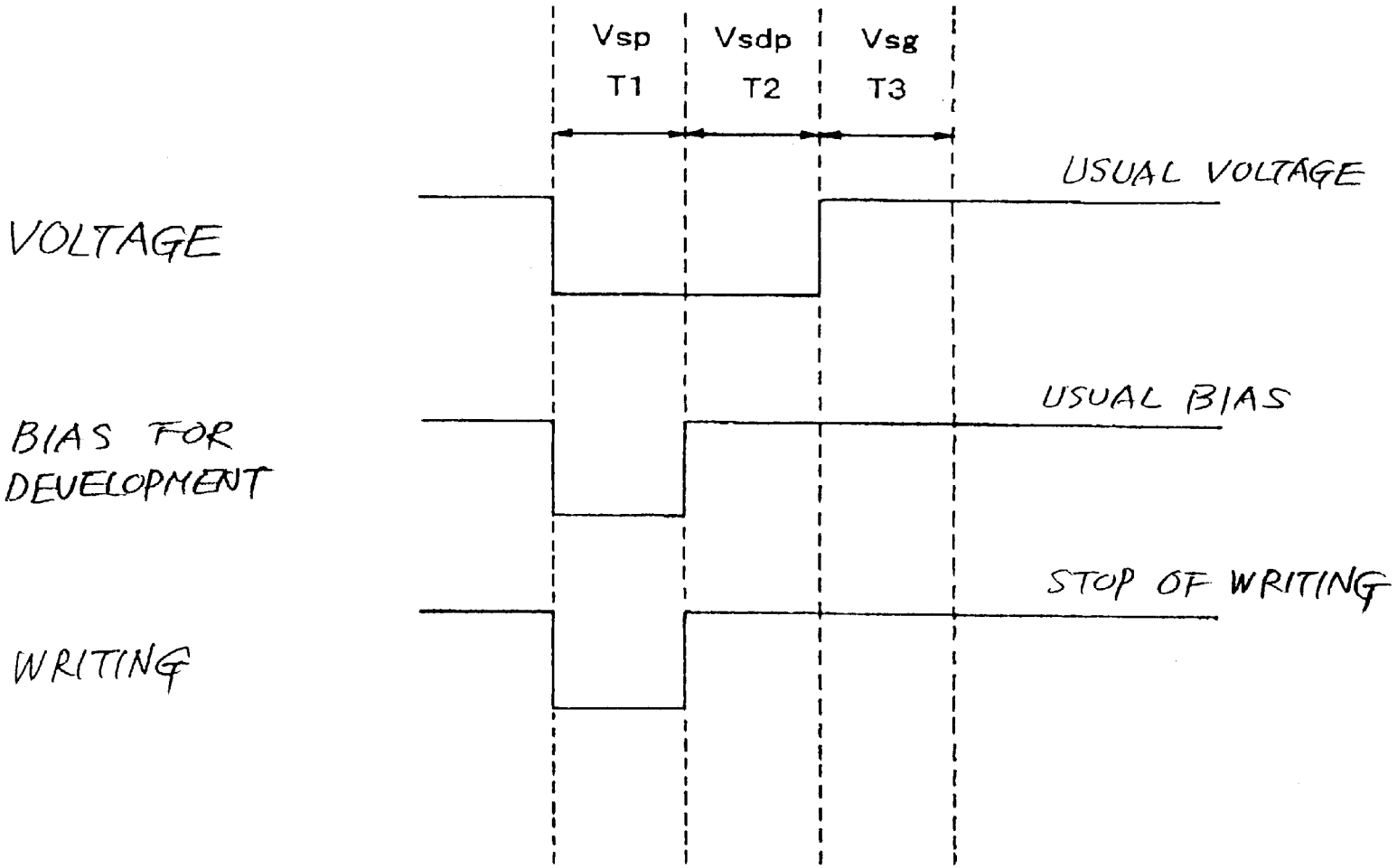
FIG. 4 is a timing chart associated with FIG. 3.

More specifically, as shown in FIG. 4, the controller 30 lowers, in correspondence to a non-image area, both of the voltage to be applied to the charger 9 and a bias for development for a preselected period of time $T_1$. At the same time, the controller 30 causes writing to start (ON) to thereby form a so-called P pattern in the non-image area of the drum 1. The photosensor 17 senses the reflection density of the P pattern and outputs a signal Vsp representative of the sensed reflection density.

Subsequently, the controller 30 raises the bias for development to a usual value while continuously applying the lowered voltage to the charger 9 for a period of time $T_2$. At the same time, the controller 30 causes writing to end (OFF) to thereby form a thin background contamination pattern on the drum 1. In this case, the photosensor 17 outputs a signal Vsdp representative of the reflection density of the background contamination pattern.

Further, the controller 30 raises the voltage to be applied to the charger 9 to a usual value while maintaining the usual bias for development and the writing OFF state for a period of time $T_3$. The photosensor 17 outputs a signal Vsg representative of the reflection density of the background of the drum 1.

Referring again to FIG. 3, the controller 30 determines whether or not a ratio Vsdp/Vsg is equal to or smaller than 0.9 (step S3). If the answer of the step S3 is NO, meaning that the ratio Vsdp/Vsg is greater than 0.9, then the main controller 30 lowers the voltage to be applied to the charge roller 9 by preselected one step (step S4) and then ends the procedure.

If the answer of the step S3 is YES, then the controller 30 further determines whether or not the ratio Vsdp/Vsg is equal to or greater than 0.85 (step S5). If the answer of the step S5 is NO, then the controller 30 raises the voltage to be applied to the charge roller 9 by one step (step S6) and then ends the procedure. If the answer of the step S5 is YES, then the controller 30 simply ends the procedure.

In the illustrative embodiment, the controller 30 controls a toner content by using the ratio Vsp/Vsg. Control over toner content using the ratio Vsp/Vsg is conventional and will not be described specifically.

As stated above, if the ambient temperature around the apparatus is higher than the reference temperature Ti, then the controller 30 causes more than 90% of power to concentrate on the fixing unit 18 without executing the prerotation mode operation. This allows the fixing unit 18 to be immediately heated to the preselected temperature within 10 seconds. If the ambient temperature is equal to or lower than the reference temperature Ti, then the controller 30 sets up the prerotation mode for driving the main motor 20 and thereby optimizes the voltage to be applied to the charge roller 9. Therefore, when the charging system is apt to become unstable, e.g., when temperature around the apparatus is low, the voltage to be applied to the charge roller 9 is raised or lowered by one step in accordance with the ratio Vsp/Vsg and stabilized thereby.

An alternative embodiment of the present invention will be described with reference to FIG. 5. This embodiment is also practicable with the apparatus shown in FIG. 2 and differs from the previous embodiment only as to the decision and processing to be executed by the controller 30. Briefly, in this embodiment, the decision means 32, FIG. 1, inhibits the voltage control means 31, FIG. 1, from executing the voltage control until a preselected period of time t necessary for the apparatus to be warmed up expires. On the elapse of the period of time t, the decision means 32 causes the voltage control means 31 to execute the voltage control described with reference to FIG. 3.

Figure 5:
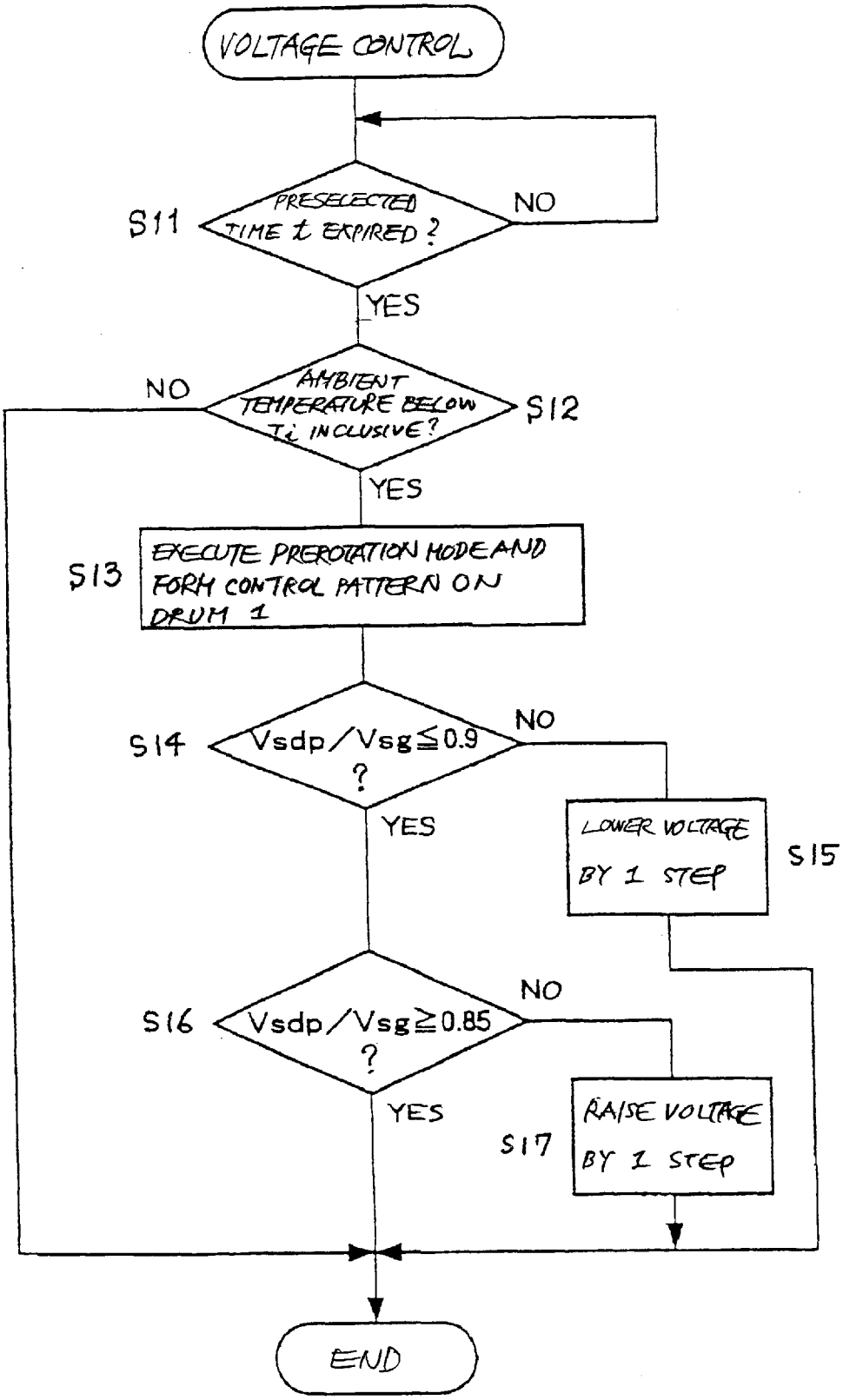
FIG. 5 is a flowchart demonstrating a procedure representative of an alternative embodiment of the present invention.

Specifically, as shown in FIG. 5, the controller 30, FIG. 1, starts executing the procedure of FIG. 5 in response to an ON signal output from the main switch arranged on the apparatus or a signal representative of recovery from the sleep mode. First, the controller 30 determines whether or not the preselected period of time t has expired since the turn-on of the main switch or the recovery from the sleep mode (step S11). If the answer of the step S1 is NO, then the controller 30 waits until the period of time t expires. If the answer of the step S1 is YES, then the controller 30 executes steps S12 through S17 identical with the steps S1 through S6 shown in FIG. 3.

As stated above, in the illustrative embodiment, the controller 30 inhibits the prerotation mode until the period of time t necessary for the apparatus to be warmed up expires. This successfully allows the apparatus to consume more than 90% of power for warm-up at the time of start-up without regard to ambient temperature around the apparatus, thereby reducing the warm-up time. On the elapse of the period of time t, the controller 30 executes the prerotation mode for optimizing the voltage to be applied to the charge roller 9, so that the fall of charging ability and therefore background contamination is obviated.

The problem with an image forming apparatus of the type holding a charge roller in contact with a photoconductive drum is that toner left on the drum after image transfer is apt to smear the charge roller, as stated earlier. In light of this, sponge or similar cleaning pad is usually held in contact with the charge roller in order to clean the charge roller. The cleaning pad, however, has its cleaning ability lowered as the apparatus is operated over a long period of time, failing to remove deposits including toner and paper dust and other impurities from the charge roller. The deposits lower a discharging ability and thereby bring about background contamination. Background contamination ascribable to such deposits is more likely to occur when the charging member is implemented as a blade on which the cleaning pad cannot be mounted.

In order to solve the above-described problem, it is a common practice to execute, before a regular image forming operation, a prerotation mode operation for forming a pattern including a white portion and a gray portion on a photoconductive drum. A photosensor senses the reflection sensitivity of the white portion and that of the gray portion. A voltage to be applied to the charge roller is controlled on the basis of the resulting output of the sensor for thereby making up for the fall of the discharging ability and obviating background contamination.

The above conventional scheme, however, consumes extra power and extra time for causing the drum to rotate and causing a developing unit to operate to form the particular pattern before a regular image forming operation. This slows down the warm-up of the apparatus after the turn-on of a main switch or the recovery from a sleep mode.

By contrast, the illustrative embodiment does not execute the prerotation mode operation, i.e., does not rotate the main motor or cause the developing unit to operate until the period of time t necessary for the apparatus to be warmed up expires. The apparatus can therefore consume more than 90% of power for warm-up and can be warmed up in a short period of time, e.g., within 10 seconds.

In summary, it will be seen that the present invention provides an image forming apparatus capable of being warmed up in a short period of time and achieving a desirable charging ability.

Various modifications will become possible for those skilled in the art after receiving teachings of the present disclosure without departing from the scope thereof.

What is claimed is:

1. An image forming apparatus comprising:

a charging member contacting or adjoining a photoconductive element for uniformly charging a surface of said photoconductive element;

latent image forming means for,forming a latent image on the surface of said photoconductive element uniformly charged;

developing means for developing the latent image with toner by reversal development to thereby form a corresponding toner image;

a temperature sensor responsive to ambient temperature around said image forming apparatus;

voltage applying means for applying a DC voltage to said charging member;

a photosensor responsive to a reflection density of the surface of said photoconductive element;

voltage control means for varying the DC voltage in correspondence to a non-image area of the surface of said photoconductive element at preselected intervals, causing said photosensor to sense the deflection density of the surface of said photoconductive element before and after a variation of said DC voltage, and controlling a voltage to be applied from said voltage applying means to said charging member in accordance with a ratio between resulting outputs of said photosensor; and decision means for determining whether or not to cause said voltage control means to execute control over the voltage.

2. The apparatus as claimed in claim 1, wherein said decision means causes said voltage control means to execute the control only if the ambient temperature sensed by said temperature sensor on a start-up of said apparatus is lower than a preselected reference temperature.

3. An image forming apparatus comprising:

a charging member contacting or adjoining a photoconductive element for uniformly charging a surface of said photoconductive element;

latent image forming means for forming a latent image on the surface of said photoconductive element uniformly charged;

developing means for developing the latent image with toner by reversal development to thereby form a corresponding toner image;

a temperature sensor responsive to ambient temperature around said image forming apparatus;

voltage applying means for applying a DC voltage to said charging member;

a photosensor responsive to a reflection density of the surface of said photoconductive element;

voltage control means for varying the DC voltage in correspondence to a non-image area of the surface of said photoconductive element at preselected intervals, causing said photosensor to sense the deflection density of the surface of said photoconductive element before and after a variation of said DC voltage, and controlling a voltage to be applied from said voltage applying means to said charging member in accordance with a ratio between resulting outputs of said photosensor; and decision means for inhibiting said voltage control means from executing control over the voltage for a preselected period of time necessary for said apparatus to be warmed up to a printing state, and then causing said voltage control means to execute said control on an elapse of said preselected period of time.

4. An image forming apparatus comprising:

a charging member contacting or adjoining a photoconductive element for uniformly charging a surface of said photoconductive element;

a latent image forming device configured to form a latent image on the surface of said photoconductive element uniformly charged;

a developing unit configured to develop the latent image with toner by reversal development to thereby form a corresponding toner image;

a temperature sensor responsive to ambient temperature around said image forming apparatus;

a voltage applying device configured to apply a DC voltage to said charging member;

a photosensor responsive to a reflection density of the surface of said photoconductive element;

a voltage control circuit configured to vary the DC voltage in correspondence to a non-image area of the surface of said photoconductive element at preselected intervals, cause said photosensor to sense the deflection density of the surface of said photoconductive element before and after a variation of said DC voltage, and control a voltage to be applied from said voltage applying device to said charging member in accordance with a ratio between resulting outputs of said photosensor; and a decision circuit configured to determine whether or not to cause said voltage control circuit to execute control over the voltage.

5. The apparatus as claimed in claim 4, wherein said decision circuit causes said voltage control circuit to execute the control only if the ambient temperature sensed by said temperature sensor on a start-up of said apparatus is lower than a preselected reference temperature.

6. An image forming apparatus comprising:

a charging member contacting or adjoining a photoconductive element for uniformly charging a surface of said photoconductive element;

a latent image forming device configured to form a latent image on the surface of said photoconductive element uniformly charged;

a developing unit configured to develop the latent image with toner by reversal development to thereby form a corresponding toner image;

a temperature sensor responsive to ambient temperature around said image forming apparatus;

a voltage applying device configured to apply a DC voltage to said charging member;

a photosensor responsive to a reflection density of the surface of said photoconductive element;

a voltage control circuit configured to vary the DC voltage in correspondence to a non-image area of the surface of said photoconductive element at preselected intervals, cause said photosensor to sense the deflection density of the surface of said photoconductive element before and after a variation of said DC voltage, and control a voltage to be applied from said voltage applying device to said charging member in accordance with a ratio between resulting outputs of said photosensor; and a decision circuit configured to inhibit said voltage control circuit from executing control over the voltage for a preselected period of time necessary for said apparatus to be warmed up to a printing state, and then cause said voltage control circuit to execute said control on an elapse of said preselected period of time.

* * * * *